US010154734B1

(12) United States Patent
Canaphany

(10) Patent No.: US 10,154,734 B1
(45) Date of Patent: Dec. 18, 2018

(54) INFLATABLE SEAT

(71) Applicant: Guangzhou BrandStand Display Systems Co., Ltd., Guangzhou (CN)

(72) Inventor: Ralph Canaphany, New South Wales (AU)

( * ) Notice: Subject to any disclaimer, the term of this patent is extended or adjusted under 35 U.S.C. 154(b) by 0 days.

(21) Appl. No.: 16/012,433

(22) Filed: Jun. 19, 2018

Related U.S. Application Data

(63) Continuation of application No. 15/893,257, filed on Feb. 9, 2018, now Pat. No. 10,028,588.

(30) Foreign Application Priority Data

Dec. 5, 2017 (CN) ..... 2017 2 1687095 U

(51) Int. Cl.
*A47C 4/54* (2006.01)

(52) U.S. Cl.
CPC ..... *A47C 4/54* (2013.01)

(58) Field of Classification Search
None
See application file for complete search history.

(56) References Cited

U.S. PATENT DOCUMENTS 4,829,616 A * 5/1989 Walker ..... A47C 27/082 200/83 Q
4,867,344 A * 9/1989 Bitterly ..... A61B 5/026 222/105
5,096,529 A * 3/1992 Baker ..... A47C 4/54 156/216
5,433,471 A * 7/1995 Shepherd ..... B60R 21/2171 280/728.2
5,468,140 A * 11/1995 Hoffman ..... B29C 43/102 249/65
6,000,079 A * 12/1999 Dranger ..... A47C 4/54 425/522
2012/0178003 A1* 7/2012 Venkataraman ..... H01M 2/00 429/408

FOREIGN PATENT DOCUMENTS

GB 1196250 A * 6/1970 ..... A47C 4/54

* cited by examiner

*Primary Examiner* — David E Allred
(74) *Attorney, Agent, or Firm* — Braxton Perrone, PLLC

(57) ABSTRACT

An inflatable seat having an internal inflatable tube disposed within a cloth barrel and framed by a pair of fixed planks secured to a pair of internal connector rings and a pair of plastic shields and covered by a decorative canvas.

14 Claims, 3 Drawing Sheets

INFLATABLE SEAT

This application is a continuation application of and claims priority to U.S. application Ser. No. 15/893,257 filed Feb. 9, 2018, which is incorporated herein in its entirety by reference. This application also claims priority to Chinese patent application no. 201721687095.4 filed Dec. 5, 2017, which is incorporated herein in its entirety by reference.

TECHNICAL FIELD

The present invention relates to an inflatable seat, which comprises an outer threaded tube sleeve, a PVC plastic panel, connecting screws, a decorative canvas fixed plank, an internal connector ring, an inner threaded tube sleeve, an inflatable airbag, an inner cloth sleeve and a decorative canvas, and an inflatable airbag sleeve arranged inside the inner cloth. The internal cloth tube is fixedly installed in two internal ring connector and fixed plank inner sides, and the decorative canvas fixed plank is fixedly connected with the connecting screws to the internal connector ring, the decorative canvas is mounted on two decorative canvas fixed plank inner ends, and the decorative canvas is arranged on the outer side of the inner cloth barrel, and the PVC plastic panel is arranged on the decorative canvas fixed plank outer face, with an outer threaded tube sleeve engaging a corresponding inner threaded tube sleeve through center openings of the PVC plastic panel, decorative canvas fixed board and internal connector ring and with the tube sleeve fixed piece fixed connection, the design optimizes the connection structure, and can be used for multiple connections, providing a stable connection.

BACKGROUND OF THE INVENTION

An air chair or sofa is usually made of raw material such as the generic inflatable product PVC. Through pressure, gas enters the chair to inflate it. But such furniture can be unwieldy like traditional furniture, whether placed indoors or outdoors. For inflatable seats, the seat's volume is small after air release, and collecting and storing the deflated seat is convenient. Inflatable furniture can be both stylish and comfortable. Nowadays, such furniture offering may be colorful, glittering and translucent as chic inflatable chairs and sofas are popular with the new and fashionable generation of users.

An inflatable seat is a single inflatable sofa, but existing inflatable seat designs are overly simplistic, lack functionality, and have been unable to meet the needs of the market. There is a need, therefore, for an inflatable seat that offers enhanced functionality.

Practicality

Aiming to overcome the deficiencies of the existing technology, the presently described inflatable seat aims to provide a seat with enhanced strength and functionality. The presently described inflatable seat according to the embodiments of the invention has the advantages of convenient use, simple operation, and practical ability.

To achieve the above purposes, the embodiments of the present invention comprise the following elements: an outer threaded tube sleeve, a PVC plastic panel, a connecting screw, a decorative canvas fixed plank, an internal connector ring, an inner threaded tube sleeve, an inflatable airbag, an inner cloth barrel and a decorative canvas, wherein the inflatable airbag sleeve is arranged inside the inner cloth barrel. The tube sleeve of the belt, the PVC plastic panel, decorative canvas fixed plank and internal connector ring are disposed at opposite ends of the inflatable bag, inner cloth tube or barrel and decorative canvas of the inflatable seat. The inner cloth tube is fixed to two internal connector rings at either end of the cloth tube, the decorative canvas fixed plank is arranged in the internal connector ring on the inner cloth barrel at opposite ends, via fixed plank outer end face on each end. And the decorative canvas fixed plank is fixedly connected with the internal connector ring through a connecting screw, the decorative canvas is mounted on two decorative canvas fixed plank inner ends, and the decorative canvas set is arranged on the outer side of the inner cloth tube or barrel, wherein the PVC plastic panel is arranged on the outer end of the decorative canvas to fix the board. A belt sleeve is arranged through a PVC plastic panel, a decorative canvas fixed plank and an internal connector ring and fixedly connected with a threaded tube sleeve.

Further, the decorative canvas is provided with a fixed plank and an inner connecting cloth cylinder fixed with grooves around which the inner cloth barrel and decorative canvas are installed. Further, in an embodiment, six connecting screws are provided, the decorative canvas fixed plank and the internal connecting cloth cylinder fixed board are provided with six threaded holes for receipt of each of the corresponding six connecting screws. Further, the PVC plastic panel, the Decorative canvas fixing board and the inner connector ring at a center position are provided with a pass through hole for the threaded tube sleeve. Further, a threaded tube sleeve is arranged on the outer end surface of the PVC plastic panel at both ends. Compared with the prior art, the presently described inflatable seat assembly has the beneficial effect of a sturdy and stable structure.

DETAILED DESCRIPTION OF THE EMBODIMENTS

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

The technical scheme in the embodiment of the utility model is clearly and completely described in combination with the drawings in the embodiment of the utility model, and it is clear that the embodiments described are only part of the embodiment of the utility model, not all embodiments. Based on the embodiment of the utility model, all other embodiments obtained by ordinary technicians in this field under the precondition of not making creative labor are the scope of the protection of the utility model.

Figure 1:
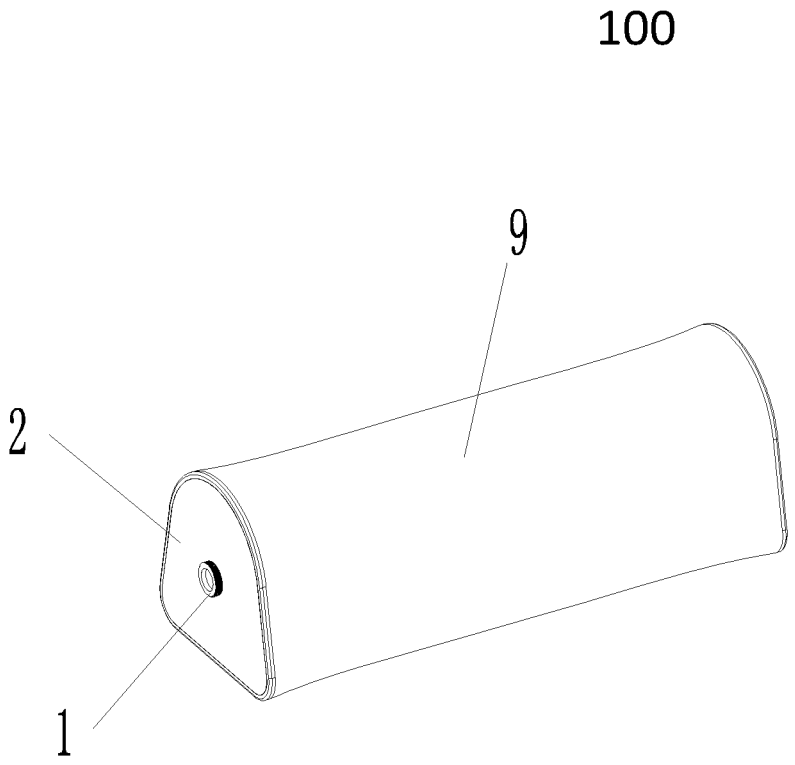
FIG. 1 is an isometric view of an embodiment of the presently described inflatable seat.
Figure 2:
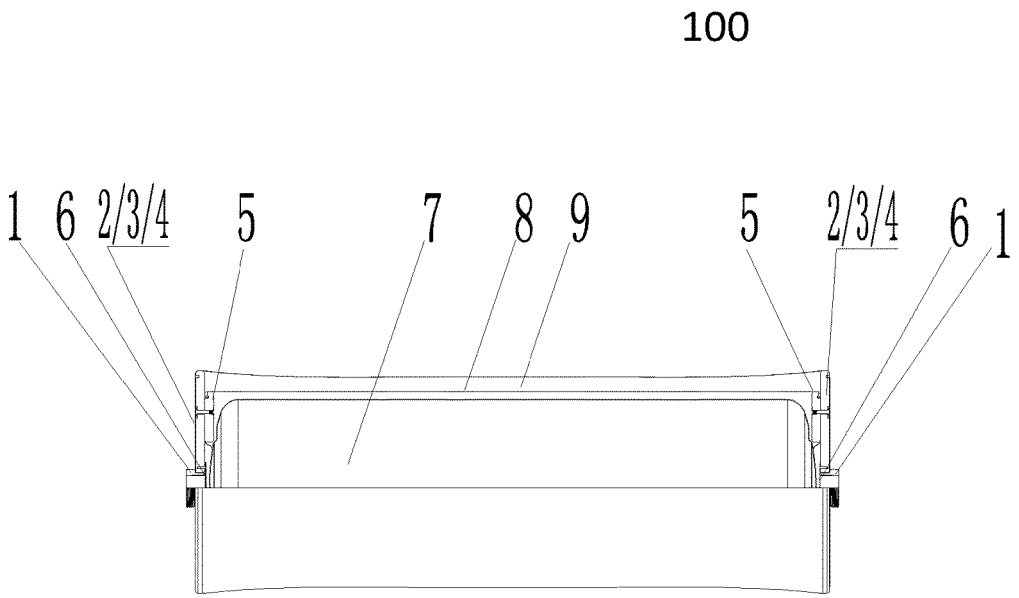
FIG. 2 is an assembled view of an embodiment of the presently described inflatable seat.

FIG. 1. depicts an embodiment of the presently described inflatable seat. As shown in FIG. 1, inflatable seat includes tooth tube sleeve 1; PVC plastic panel 2 and decorative canvas 9. FIG. 2 provides a more detailed view of the components of the presently described inflatable seat. As shown in FIG. 2, inflatable seat comprises tooth tube sleeves 1 on opposite ends of inflatable seat 100. Also on opposite ends of inflatable seat 100 are PVC plastic panel 2, fixed wooden boards with decorative canvas covering 4, with connecting screws 3 that serve to connect fixed wooden boards 4 to other interior components of inflatable seat 100. Also interior to fixed wooden boards 4 at each end of inflatable chair 100 are internal ring connectors 5 that connect fixed wooden planks 4 to internal cloth tube 8 inside of which inflatable airbag 7 sits. Tube sleeves 6 at either end of internal cloth tube 8 engage corresponding toothed tube sleeve 1 to secure the PVC plastic panel 2 at each end of inflatable seat 100 to corresponding fixed wooden boards 4.

Figure 3:
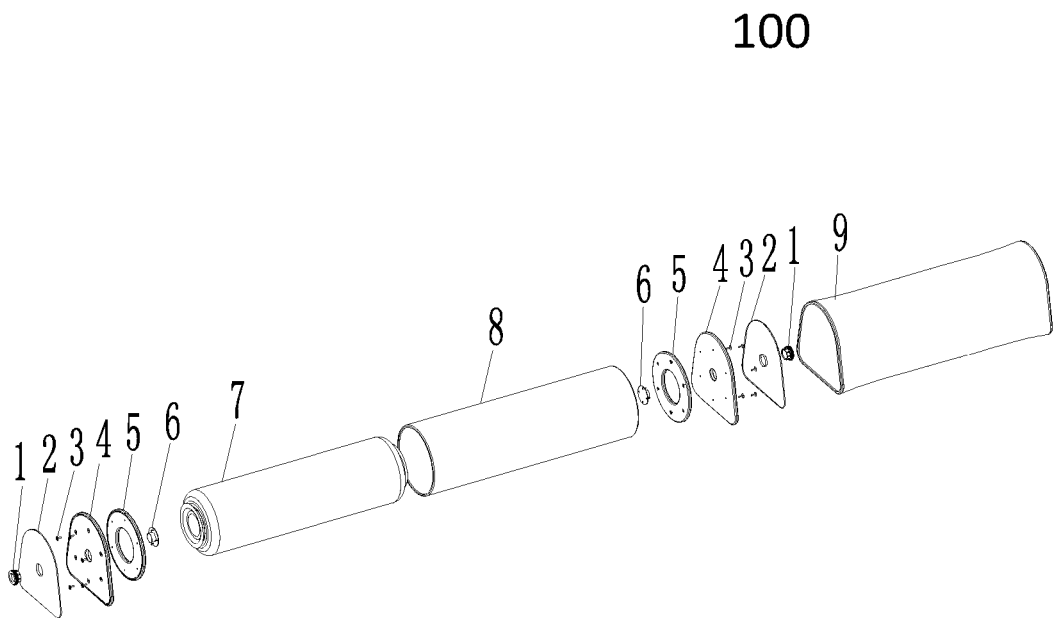
FIG. 3 is a disassembled view of an embodiment of the presently described inflatable seat.

FIG. 3 provides a disassembled view of the components 1-9 of inflatable seat 100 while FIG. 2 provides an assembled view of the various components 1-9 of inflatable seat 100. Ultimately, when assembled, decorative canvas covering 9 provides the inflatable seat cover that is visible to the user, while inflatable airbag 7 and internal cloth tube 8 reside within decorative canvas covering 9.

The presently described embodiment of the inflatable seat comprise a toothed tube sleeve 1, PVC plastic panel 2, connection screws 3, decorative canvas fixed plank 4, internal connection cloth cylinder fixed plank 5, with tube sleeves 6 to engage corresponding toothed tube sleeves 1 to secure PVC plastic panel 2 to decorative canvas fixed plank 4; inflatable airbag 7, internal cloth tube 8 in which inflatable airbag 7 sits, and decorative canvas 9 in which inflatable airbag 7 and internal cloth tube 8 sit. Internal ring connectors 5 at opposite ends of internal cloth tube 8 and inflatable airbag 7 serve to connect decorative canvas fixed plank 4 and in turn PVC plastic panel 2 at opposite ends of internal cloth tube 8. The entire assembly of components 1-8 slide into decorative canvas 9, which gives inflatable seat 100 a decorative appearance and durable outer material.

Decorative canvas fixed plank 4 and internal ring connector 5 have open grooves, used to install internal cloth tube 8 and decorative canvas 9. Connection screws 3 secure decorative canvas fixed plank 4 to internal ring connector 5 and outer threaded tube sleeve 1 engages and inner threaded tube sleeve 6 to secure PVC plastic panel 2 to decorative canvas fixed plank 4. In one embodiment, internal ring connector 5 includes six threaded screw holes to receive six connecting screws 3. PVC plastic panel 2, decorative canvas fixed plank 4 and internal connection ring 5 have center openings to receive outer threaded tube sleeve 1 through the center hole, with outer threaded tube sleeve 1 engaged by a corresponding inner threaded tube sleeve 6.

In operation, inflatable airbag 7 is inflated to support and occupy internal cloth tube 8, which in turn expands to ends to internal connector ring 5, so that the two sides of the internal cloth tube 8 and connector ring 5 and associated decorative canvas fixed plank 4 form a light box. Decorative canvas fixed plank 4 and internal connector ring 5 all can have grooves, used to securely install internal cloth tube 8 and decorative canvas 9 there around. In this manner, inflatable airbag 7 is secured within the housing formed by canvas fixed planks 4, internal ring connectors 5 and internal cloth tube 8 to prevent unwanted lateral movement of inflatable airbag 7.

The above depicts and describes the basic principles and main characteristics of the present invention and the advantages thereof. For one of skill in the art, the present invention is not limited to the details of the exemplary embodiments mentioned above, and can realize the present invention in other concrete forms without deviating from the spirit or basic characteristic of the invention. So, from whatever point of view, the embodiments shall be deemed to be exemplary and unrestricted, and the scope of the present invention is defined by the attached claims rather than the above-mentioned description, and therefore is intended to encompass all changes within the meaning and scope of the equivalent element claimed.

Although the embodiment of the utility model has been shown and described, for the general technical staff in the field, it can be understood that these embodiments can be varied, modified, replaced and revised without departing from the principle and spirit of the present invention, and the scope of the invention shall be defined by the attached claims and their equivalent.

Different embodiments employing the concept and teachings of the invention will be apparent and obvious to those of ordinary skill in this art and these embodiments are likewise intended to be within the scope of the claims. The inventor does not intend to abandon any disclosed inventions that are reasonably disclosed but do not appear to be literally claimed below, but rather intends those embodiments to be included in the broad claims either literally or as equivalents to the embodiments that are literally included.

While the disclosed embodiments have been described with reference to one or more particular implementations, these implementations are not intended to limit or restrict the scope or applicability of the invention. Those having ordinary skill in the art will recognize that many modifications and alterations to the disclosed embodiments are available. Therefore, each of the foregoing embodiments and obvious variants thereof is contemplated as falling within the spirit and scope of the disclosed inventions.

While the invention has been particularly shown and described with reference to a preferred embodiment, it will be understood by those skilled in the art that various changes in form and detail can be made therein without departing from the spirit and scope of the invention.

I claim:

1. An inflatable seat, comprising:

a first outer tubular fastening sleeve and a first inner tubular fastening sleeve;

a second outer tubular fastening sleeve and a second inner tubular fastening sleeve;

a first panel and a second panel;

a first fixed plank and a second fixed plank;

a first internal connector ring and a second internal connector ring;

an inflatable airbag;

an inner tube; and a decorative cover providing a seating surface of the inflatable seat, wherein the first outer tubular fastening sleeve engages the first inner tubular fastening sleeve through a central opening in each of the first panel, the first fixed plank and the first internal connector ring, wherein the second outer tubular fastening sleeve engages the second inner tubular fastening sleeve through a central opening in each of the second panel, the second fixed plank and the second internal connector ring, wherein the inflatable airbag is disposed inside of the inner tube and framed by the first and second panels, the first and second fixed planks and the first and second internal connector rings, and wherein the decorative cover is mounted on the first and second fixed planks.

2. The inflatable seat of claim 1, wherein the first fixed plank and the second fixed plank comprise-a:

a decorative outer canvas; and a plurality of grooves around which the inner cloth tube and the decorative canvas are installed.

3. The inflatable seat of claim 1, wherein the first panel and the second panel are polyvinyl chloride (PVC) panels.

4. The inflatable seat of claim 1, wherein the first and second panels, the first and second fixed planks and the inner connector ring comprise a through hole for the insertion of an associated first and second tubular fastening sleeve.

5. The inflatable seat of claim 1, wherein the first outer tubular fastening sleeve is threaded and arranged on an outer side of the first panel.

6. The inflatable seat of claim 1, wherein the inner tube is made of cloth.

7. The inflatable seat of claim 1, wherein the first fixed plank is connected to the first internal connector ring and the second fixed plank is connected to the second internal connector ring.

8. An inflatable seat, comprising:

at least one outer tubular fastening sleeve and at least one inner tubular fastening sleeve;

at least one plastic panel;

at least one fixed plank;

at least one internal connector ring;

an inflatable airbag;

an inner tube; and a decorative cover providing a seating surface of the inflatable seat, wherein the at least one outer tubular fastening sleeve engages the at least one inner tubular fastening sleeve through a central opening in each of the at least one plastic panel, the at least one fixed plank and the at least one internal connector ring, wherein the inflatable airbag is disposed inside of the inner tube and framed by the at least one plastic panel, the at least one plank and the at least one internal connector ring, and wherein the decorative cover is mounted on the at least one fixed plank.

9. The inflatable seat of claim 8, wherein the at least one fixed plank comprises:

a decorative outer canvas; and a plurality of grooves around which the inner cloth tube and the decorative canvas are installed.

10. The inflatable seat of claim 8, wherein the at least one plastic panel is a polyvinyl chloride (PVC) panel.

11. The inflatable seat of claim 8, wherein the at least one plastic panel, the at least one fixed plank and the at least one internal connector ring comprise a through hole for the insertion of an associated at least one inner tubular fastening sleeve.

12. The inflatable seat of claim 8, wherein the at least one outer tubular fastening sleeve is threaded and arranged on an outer side of the at least one plastic panel.

13. The inflatable seat of claim 8, wherein the inner tube is made of cloth.

14. The inflatable seat of claim 8, wherein the at least one fixed plank is connected to the at least one internal connector ring.

* * * * *